US009727008B2

(12) United States Patent
Kawata et al.

(10) Patent No.: US 9,727,008 B2
(45) Date of Patent: Aug. 8, 2017

(54) FIXING DEVICE AND IMAGE FORMING APPARATUS INCLUDING THE FIXING DEVICE

(71) Applicants: Teppei Kawata, Kanagawa (JP); Masahiko Satoh, Tokyo (JP); Kenji Ishii, Kanagawa (JP); Masaaki Yoshikawa, Tokyo (JP); Hiroshi Yoshinaga, Chiba (JP); Takeshi Uchitani, Kanagawa (JP); Tadashi Ogawa, Tokyo (JP); Hiromasa Takagi, Tokyo (JP); Naoki Iwaya, Tokyo (JP); Takuya Seshita, Kanagawa (JP); Takahiro Imada, Kanagawa (JP); Hajime Gotoh, Kanagawa (JP); Takamasa Hase, Shizuoka (JP); Kazuya Saito, Kanagawa (JP); Toshihiko Shimokawa, Kanagawa (JP); Shuutaroh Yuasa, Kanagawa (JP); Arinobu Yoshiura, Kanagawa (JP); Kensuke Yamaji, Kanagawa (JP); Akira Suzuki, Tokyo (JP)

(72) Inventors: Teppei Kawata, Kanagawa (JP); Masahiko Satoh, Tokyo (JP); Kenji Ishii, Kanagawa (JP); Masaaki Yoshikawa, Tokyo (JP); Hiroshi Yoshinaga, Chiba (JP); Takeshi Uchitani, Kanagawa (JP); Tadashi Ogawa, Tokyo (JP); Hiromasa Takagi, Tokyo (JP); Naoki Iwaya, Tokyo (JP); Takuya Seshita, Kanagawa (JP); Takahiro Imada, Kanagawa (JP); Hajime Gotoh, Kanagawa (JP); Takamasa Hase, Shizuoka (JP); Kazuya Saito, Kanagawa (JP); Toshihiko Shimokawa, Kanagawa (JP); Shuutaroh Yuasa, Kanagawa (JP); Arinobu Yoshiura, Kanagawa (JP); Kensuke Yamaji, Kanagawa (JP); Akira Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/716,929

(22) Filed: Dec. 17, 2012

(65) Prior Publication Data

US 2013/0183070 A1 Jul. 18, 2013

(30) Foreign Application Priority Data

Jan. 13, 2012 (JP) ..... 2012-005184

(51) Int. Cl.
*G03G 15/20* (2006.01)

(52) U.S. Cl.
CPC ..... *G03G 15/2017* (2013.01); *G03G 15/2053* (2013.01)

(58) Field of Classification Search
CPC ..... G03G 15/20; G03G 15/2032; G03G 15/2067; G03G 15/2085; G03G 2215/20;
(Continued)

(56) References Cited

U.S. PATENT DOCUMENTS 5,257,078 A 10/1993 Kuroda
5,300,996 A 4/1994 Yokoyama et al.
(Continued)

FOREIGN PATENT DOCUMENTS

CN 1453666 A 11/2003
CN 1652040 A 8/2005
(Continued)

OTHER PUBLICATIONS

U.S. Appl. No. 13/557,841, filed Jul. 25, 2012, Toshihiko Shimokawa, et al.
(Continued)

*Primary Examiner* — Clayton E Laballe
*Assistant Examiner* — Victor Verbitsky
(74) *Attorney, Agent, or Firm* — Oblon, McClelland, Maier & Neustadt, L.L.P.

(57) ABSTRACT

A fixing device for fixing an image on a recording medium includes an endless fixing rotary member which is formed into a loop and comes into contact with the image on the recording medium, an opposed rotary member which is in contact with the fixing rotary member, a nip forming member provided inside the loop of the fixing rotary member to be in contact with the opposed rotary member via the fixing rotary member to form a nip portion to which the recording medium is fed in a feeding direction, a support member which supports the nip forming member, and a heating source which heats the fixing rotary member. The nip forming member includes a downstream portion extending downstream in the feeding direction from a center of the nip portion and an upstream portion extending upstream in the
(Continued)

feeding direction from the center and longer than the downstream portion.

36 Claims, 8 Drawing Sheets

(58) Field of Classification Search
CPC ... G03G 2215/2022; G03G 2215/2025; G03G 2215/2035; G03G 2215/2041
See application file for complete search history.

(56) References Cited

U.S. PATENT DOCUMENTS 5,832,354 A 11/1998 Kouno et al.
RE36,124 E 3/1999 Yokoyama et al.
5,915,147 A 6/1999 Kouno et al.
5,960,243 A 9/1999 Daigo et al.
6,636,709 B2 10/2003 Furukawa et al.
7,469,120 B2 * 12/2008 Iwasaki ..... G03G 15/2028 399/328
7,769,333 B2 * 8/2010 Shin ..... G03G 15/2053 399/329
8,224,221 B2 * 7/2012 Matsuki ..... G03G 15/2064 399/329
2002/0067936 A1 6/2002 Yasui et al.
2003/0000933 A1 1/2003 Yoshinaga et al.
2003/0016963 A1 1/2003 Yoshinaga et al.
2003/0170054 A1 * 9/2003 Suzuki ..... G03G 15/2064 399/328
2003/0206756 A1 11/2003 Kanamori et al.
2003/0206758 A1 11/2003 Yasui et al.
2004/0013453 A1 1/2004 Shinshi et al.
2004/0247334 A1 12/2004 Kishi et al.
2004/0258426 A1 12/2004 Kishi et al.
2005/0025539 A1 2/2005 Yoshinaga
2005/0074251 A1 4/2005 Katoh et al.
2005/0095043 A1 5/2005 Yoshinaga et al.
2005/0129432 A1 6/2005 Sato et al.
2005/0147436 A1 7/2005 Koyama et al.
2005/0163543 A1 7/2005 Satoh et al.
2005/0169655 A1 8/2005 Koyama et al.
2006/0051120 A1 3/2006 Kishi et al.
2006/0116230 A1 6/2006 Satoh et al.
2006/0165429 A1 7/2006 Satoh et al.
2006/0165446 A1 7/2006 Kikuchi
2006/0165448 A1 7/2006 Yoshinaga
2006/0177232 A1 8/2006 Ehara et al.
2006/0182460 A1 8/2006 Kishi et al.
2006/0285893 A1 12/2006 Ishii
2007/0014600 A1 1/2007 Ishii et al.
2007/0014603 A1 1/2007 Satoh et al.
2007/0059011 A1 3/2007 Seo et al.
2007/0059071 A1 3/2007 Shinshi et al.
2007/0110464 A1 5/2007 Nakayama et al.
2007/0212089 A1 9/2007 Seo et al.
2007/0280754 A1 12/2007 Ogawa et al.
2007/0292175 A1 12/2007 Shinshi
2008/0044196 A1 2/2008 Seo et al.
2008/0063443 A1 3/2008 Yoshinaga et al.
2008/0253789 A1 10/2008 Yoshinaga et al.
2008/0317532 A1 12/2008 Ehara et al.
2009/0067902 A1 3/2009 Yoshinaga et al.
2009/0123201 A1 5/2009 Ehara et al.
2009/0123202 A1 5/2009 Yoshinaga et al.
2009/0148204 A1 6/2009 Yoshinaga et al.
2009/0169232 A1 7/2009 Kunii et al.
2009/0245865 A1 10/2009 Shinshi et al.
2010/0074667 A1 3/2010 Ehara et al.
2010/0086335 A1 4/2010 Sugaya
2010/0092220 A1 4/2010 Hasegawa et al.
2010/0092221 A1 4/2010 Shinshi et al.
2010/0202809 A1 8/2010 Shinshi et al.
2010/0290822 A1 11/2010 Hasegawa et al.
2011/0026988 A1 2/2011 Yoshikawa et al.
2011/0044706 A1 2/2011 Iwaya et al.
2011/0044734 A1 2/2011 Shimokawa et al.
2011/0052237 A1 3/2011 Yoshikawa et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0064450 A1 3/2011 Ishii et al.
2011/0064490 A1 3/2011 Imada et al.
2011/0076071 A1 3/2011 Yamaguchi et al.
2011/0085832 A1 4/2011 Hasegawa et al.
2011/0091253 A1 4/2011 Seo et al.
2011/0091254 A1 * 4/2011 Shin ..... G03G 15/2064 399/333
2011/0116848 A1 5/2011 Yamaguchi et al.
2011/0129268 A1 6/2011 Ishii et al.
2011/0158717 A1 6/2011 Suzuki et al.
2011/0164906 A1 7/2011 Ishida et al.
2011/0170917 A1 7/2011 Yoshikawa et al.
2011/0170920 A1 7/2011 Fujiwara et al.
2011/0182634 A1 7/2011 Ishigaya et al.
2011/0182638 A1 7/2011 Ishii et al.
2011/0188909 A1 * 8/2011 Suzuki ..... G03G 15/20 399/330
2011/0194869 A1 8/2011 Yoshinaga et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0211881 A1 9/2011 Suzuki et al.
2011/0217056 A1 9/2011 Yoshinaga et al.
2011/0217057 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222888 A1 9/2011 Ikebuchi et al.
2011/0222929 A1 9/2011 Fujimoto et al.
2011/0222930 A1 9/2011 Fujimoto et al.
2011/0222931 A1 9/2011 Shinshi et al.
2011/0229161 A1 9/2011 Ueno et al.
2011/0229180 A1 9/2011 Saito
2011/0229181 A1 9/2011 Iwaya et al.
2011/0229200 A1 9/2011 Yamaguchi et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0274453 A1 11/2011 Shimokawa et al.
2011/0286758 A1 11/2011 Yoshinaga
2011/0293309 A1 12/2011 Hase
2011/0311284 A1 12/2011 Seo et al.
2012/0045226 A1 2/2012 Hase et al.
2012/0051766 A1 3/2012 Ueno et al.
2012/0051774 A1 3/2012 Ikebuchi et al.
2012/0093531 A1 4/2012 Yuasa et al.
2012/0093551 A1 4/2012 Ogawa et al.
2012/0107005 A1 5/2012 Hase et al.
2012/0114345 A1 5/2012 Fujimoto et al.
2012/0114354 A1 5/2012 Saito et al.
2012/0121303 A1 5/2012 Takagi et al.
2012/0121304 A1 5/2012 Tokuda et al.
2012/0121305 A1 5/2012 Yoshikawa et al.
2012/0148303 A1 6/2012 Yamaguchi et al.
2012/0155935 A1 6/2012 Yoshikawa et al.
2012/0155936 A1 6/2012 Yamaguchi et al.
2012/0177388 A1 7/2012 Imada et al.
2012/0177393 A1 7/2012 Ikebuchi et al.
2012/0177420 A1 7/2012 Shimokawa et al.
2012/0177423 A1 7/2012 Imada et al.
2012/0177424 A1 7/2012 Saito et al.
2012/0207523 A1 8/2012 Ueno et al.
2012/0219312 A1 8/2012 Yuasa et al.
2012/0224878 A1 9/2012 Ikebuchi et al.
2012/0237273 A1 9/2012 Yoshinaga et al.
2013/0287459 A1 10/2013 Fujiwara

(56) References Cited

U.S. PATENT DOCUMENTS

FOREIGN PATENT DOCUMENTS

| | | | |
|---|---|---|---|
| CN | 102081333 | A | 6/2011 |
| CN | 102193431 | A | 9/2011 |
| CN | 102193455 | A | 9/2011 |
| EP | 2 180 379 | A1 | 4/2010 |
| EP | 2 330 466 | A1 | 6/2011 |
| EP | 2 363 758 | A1 | 9/2011 |
| EP | 2 369 427 | A2 | 9/2011 |
| EP | 2 369 427 | A3 | 9/2011 |
| JP | 2-253282 | | 10/1990 |
| JP | 2003-057978 | | 2/2003 |
| JP | 2005-202374 | | 7/2005 |
| JP | 2006-092785 | | 4/2006 |
| JP | 2006-267901 | | 10/2006 |
| JP | 2007-233011 | | 9/2007 |
| JP | 2007-334205 | | 12/2007 |
| JP | 2010-026256 | | 2/2010 |
| JP | 2011-137933 | | 7/2011 |

OTHER PUBLICATIONS

U.S. Appl. No. 13/608,128, filed Sep. 10, 2012, Shuutaroh Yuasa, et al.

Partial European Search Report Issued Jun. 10, 2013 in Patent Application No. 12197771.4.

Extended European Search Report Issued Nov. 11, 2013 in Patent Application No. 12197771.4.

U.S. Appl. No. 13/690,882, filed Nov. 30, 2012, Yoshinaga, et al.

U.S. Appl. No. 13/692,389, filed Dec. 3, 2012, Gotoh, et al.

U.S. Appl. No. 13/716,929, filed Dec. 17, 2012, Kawata, et al.

U.S. Appl. No. 13/717,046, filed Dec. 17, 2012, Iwaya, et al.

Office Action dated Dec. 1, 2014 in Japanese Patent Application No. 2012-005184.

Chinese Office Action dated Sep. 11, 2015 for corresponding Chinese Application No. 201210562751.3.

* cited by examiner

FIXING DEVICE AND IMAGE FORMING APPARATUS INCLUDING THE FIXING DEVICE

CROSS-REFERENCE TO RELATED APPLICATION

This patent application is based on and claims priority pursuant to 35 U.S.C. §119 to Japanese Patent Application No. 2012-005184, filed on Jan. 13, 2012, in the Japan Patent Office, the entire disclosure of which is hereby incorporated by reference herein.

BACKGROUND OF THE INVENTION

Field of the Invention

The present invention relates to a fixing device which fixes an image on a recording medium, and an image forming apparatus including the fixing device.

Description of the Related Art

A variety of image forming apparatuses, such as copiers, printers, facsimile machines, and multifunction machines combining several of the functions of these apparatuses, use a fixing device which includes a relatively thin fixing belt constructed, for example, of a metal substrate and an elastic rubber surface layer. With such a relatively thin fixing belt, the energy required to heat the fixing belt is substantially reduced, and a reduction in warm-up time and first-print time is achieved. The warm-up time refers to the time taken to raise the temperature of the fixing belt from a normal temperature to a predetermined reload temperature allowing printing when, for example, power is turned on. The first-print time refers to the time from the reception of a print request to the completion of a sheet discharging operation followed by a print preparatory operation and a printing operation.

As illustrated in FIG. 1, this type of fixing device includes an endless belt 100, a metal heat conductor 200, a heat source 300, and a pressure roller 400. The endless belt 100 serves as a fixing belt. The metal heat conductor 200 is formed into a pipe shape, and is disposed inside the endless belt 100. The heat source 300 is disposed inside the metal heat conductor 200. The pressure roller 400 is in contact with the metal heat conductor 200 via the endless belt 100 to form a nip portion N. In this case, the endless belt 100 is rotated by the rotation of the pressure roller 400. In this process, the metal heat conductor 200 guides the movement of the endless belt 100. Further, the endless belt 100 is heated, via the metal heat conductor 200, by the heat source 300 inside the metal heat conductor 200. Thereby, the entire endless belt 100 is heated. Accordingly, the first-print time following a heating standby time is reduced, and the shortage of heat in high-speed belt rotation is minimized.

To achieve further energy conservation and reduction in first-print time, the fixing device may be configured to directly heat the endless belt 100 without using the metal heat conductor 200. In the example illustrated in FIG. 2, the pipe-shaped metal heat conductor 200 is removed from the inside of the endless belt 100, and is replaced by a plate-shaped nip forming member 500 provided at a position facing the pressure roller 400. In this case, a portion of the endless belt 100 other than a portion of the endless belt 100 contacting the nip forming member 500 is directly heated by the heat source 300, thereby substantially improving the heat transfer efficiency and reducing power consumption. Accordingly, the first-print time following the heating standby time is further reduced, and moreover a reduction in cost due to the absence of the metal heat conductor 200 can be expected.

The fixing device may also be configured to include deformation preventing ribs for preventing the endless belt 100 from being pressed and deformed radially inward by, for example, a plurality of sheets fed in an overlapped manner.

In the fixing device including the above-described endless belt 100, at a position upstream of the nip portion N in the sheet feeding direction indicated by the arrows, the rotated endless belt 100 is pulled toward the nip portion N, and thereby tension is generated. In the configuration which guides the endless belt 100 by using the nip forming member 500, therefore, the rotated endless belt 100 comes into relatively hard contact with an upstream edge of the nip forming member 500, and thus may be damaged or broken.

Such damage or breakage of the endless belt is more likely to occur particularly in a fixing device which uses an endless belt further reduced in thickness to meet demand in recent years for energy conservation and reduction in first-print time and thus reduced in strength.

SUMMARY OF THE INVENTION

The present invention provides a novel fixing device that, in one example, fixes an image on a recording medium and includes an endless fixing rotary member, an opposed rotary member, a nip forming member, a support member, and a heating source. The fixing rotary member is formed into a loop and configured to come into contact with the image carried on the recording medium. The opposed rotary member is configured to be in contact with the fixing rotary member. The nip forming member is provided inside the loop formed by the fixing rotary member to be in contact with the opposed rotary member via the fixing rotary member to form, between the fixing rotary member and the opposed rotary member, a nip portion to which the recording medium is fed in a feeding direction. The nip forming member includes a downstream portion extending downstream in the feeding direction from a center of the nip portion, and an upstream portion extending upstream in the feeding direction from the center of the nip portion and longer than the downstream portion. The support member is configured to support the nip forming member. The heating source is configured to heat the fixing rotary member.

The present invention further provides a novel image forming apparatus that, in one example, includes an image forming unit configured to form an image on a recording medium and the above-described fixing device configured to fix the image on the recording medium.

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
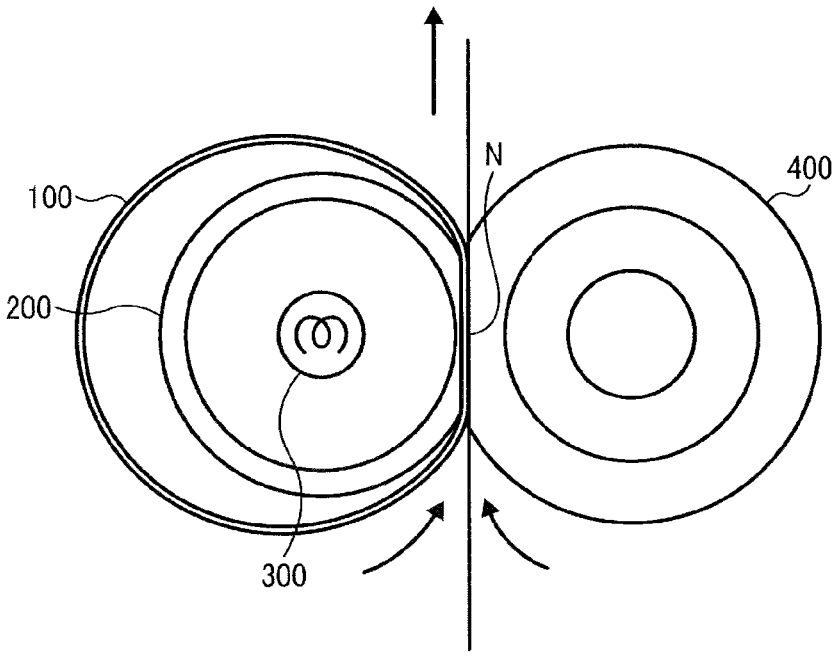
FIG. 1 RELATED ART
FIG. 1 is a schematic configuration diagram of a related-art fixing device.
Figure 2:
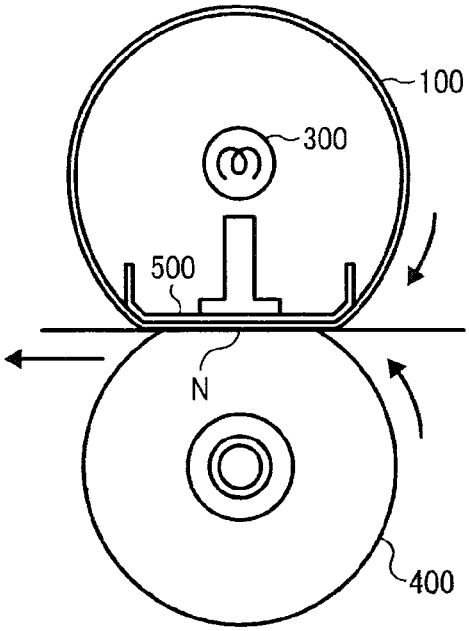
FIG. 2 RELATED ART
FIG. 2 is a schematic configuration diagram of another related-art fixing device.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner and achieve a similar result.

Referring now to the drawings, wherein like reference numerals designate members or components having the same function or shape throughout the several views, embodiments of the present invention will be described. In the following, redundant description of members or components once described will be omitted.

Figure 3:
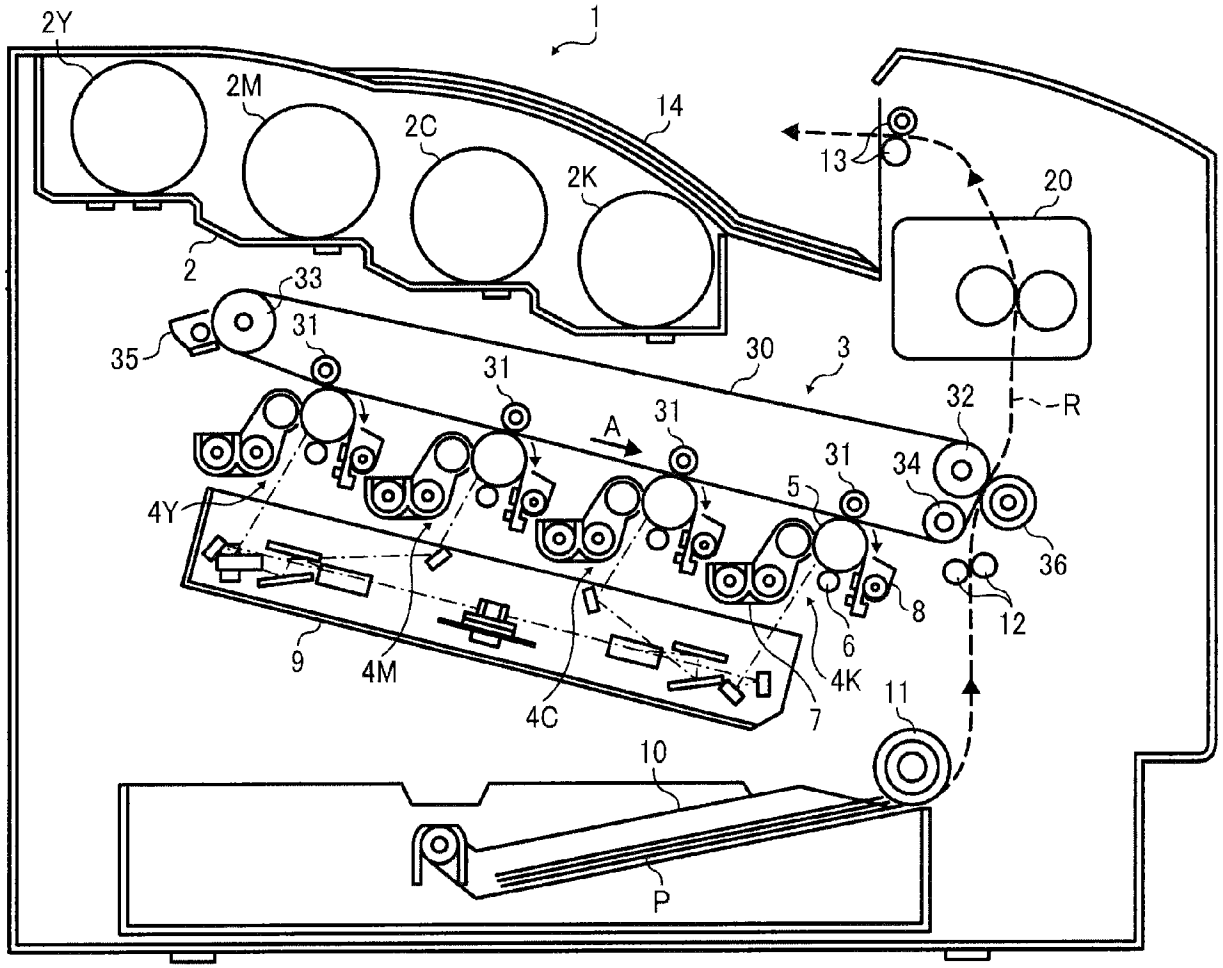
FIG. 3 is schematic configuration diagram illustrating an image forming apparatus according to an embodiment of the present invention.

With reference to FIG. 3, a description will first be given of the overall configuration and operation of an image forming apparatus according to an embodiment of the present invention.

An image forming apparatus 1 illustrated in FIG. 3 is a color laser printer including four image forming units 4Y, 4M, 4C, and 4K disposed at substantially the center of the body thereof. The image forming units 4Y, 4M, 4C, and 4K are similar in configuration except for the difference in color of developers contained therein. That is, the image forming units 4Y, 4M, 4C, and 4K contain developers of yellow (Y), magenta (M), cyan (C), and black (K) colors, respectively, which correspond to color separation components of a color image.

Specifically, each of the image forming units 4Y, 4M, 4C, and 4K includes a drum-shaped photoconductor 5 serving as a latent image carrier, a charging device 6 which charges the outer circumferential surface of the photoconductor 5, a development device 7 which supplies toner to the outer circumferential surface of the photoconductor 5, and a cleaning device 8 which cleans the outer circumferential surface of the photoconductor 5. In FIG. 3, reference numerals are assigned to the photoconductor 5, the charging device 6, the development device 7, and the cleaning device 8 included in the image forming unit 4K for the black color, and are omitted in the other image forming units 4Y, 4M, and 4C.

Below the image forming units 4Y, 4M, 4C, and 4K, an exposure device 9 is provided which exposes the respective outer circumferential surfaces of the photoconductors 5. The exposure device 9, which includes light sources, a polygon mirror, f-θ lenses, and reflecting mirrors, selectively irradiates the outer circumferential surfaces of the photoconductors 5 with beams of laser light on the basis of image data.

Above the image forming units 4Y, 4M, 4C, and 4K, a transfer device 3 is provided which includes an intermediate transfer belt 30 serving as a transfer member, four primary transfer rollers 31 serving as primary transfer devices, a secondary transfer roller 36 serving as a secondary transfer device, a secondary transfer backup roller 32, a cleaning backup roller 33, a tension roller 34, and a belt cleaning device 35.

The intermediate transfer belt 30 is an endless belt stretched around the secondary transfer backup roller 32, the cleaning backup roller 33, and the tension roller 34. In the present embodiment, the secondary transfer backup roller 32 is driven to rotate, and causes the intermediate transfer belt 30 to rotate in the direction indicated by arrow A in FIG. 3.

The four primary transfer rollers 31 and the photoconductors 5 hold the intermediate transfer belt 30 therebetween to form primary transfer nips. Each of the primary transfer rollers 31 is connected to a not-illustrated power supply, and is supplied with a predetermined direct-current (DC) voltage and/or a predetermined alternating-current (AC) voltage.

The secondary transfer roller 36 and the secondary transfer backup roller 32 hold the intermediate transfer belt 30 therebetween to form a secondary transfer nip. Similarly to the primary transfer rollers 31, the secondary transfer roller 36 is connected to a not-illustrated power supply, and is supplied with a predetermined DC voltage and/or a predetermined AC voltage.

The belt cleaning device 35 includes a cleaning brush and a cleaning blade, which are disposed to be in contact with the intermediate transfer belt 30. A not-illustrated waste toner transport tube extending from the belt cleaning device 35 is connected to an inlet of a not-illustrated waste toner container.

In an upper portion of the body of the image forming apparatus 1, a bottle housing unit 2 is provided. Four toner bottles 2Y, 2M, 2C, and 2K each containing refill toner are installed in the bottle housing unit 2 to be attachable thereto and detachable therefrom. Not-illustrated refill paths are provided between the toner bottles 2Y, 2M, 2C, and 2K and the development devices 7 to allow the development devices 7 to be refilled with the toners from the toner bottles 2Y, 2M, 2C, and 2K via the refill paths.

Meanwhile, in a lower portion of the body of the image forming apparatus 1, a sheet feeding tray 10 and a sheet feed roller 11 are provided. The sheet feeding tray 10 stores a sheet P serving as a recording medium, and the sheet feed roller 11 feeds the sheet P from the sheet feeding tray 10. Herein, the recording medium includes, as well as plain paper, cardboard, a postcard, an envelope, thin paper, coated paper, art paper, tracing paper, and an overhead projector (OHP) sheet, for example. Optionally, the image forming apparatus 1 may also include a manual sheet feeding mechanism, which for simplicity is not illustrated herein.

In the body of the image forming apparatus 1, a feed path R is provided to allow the sheet P fed from the sheet feeding tray 10 to pass through the secondary transfer nip and be discharged outside the image forming apparatus 1. On the upstream side of the secondary transfer roller 36 in the sheet feeding direction, the feed path R is provided with a registration roller pair 12 serving as a feeding device which feeds the sheet P to the secondary transfer nip.

On the downstream side of the secondary transfer roller 36 in the sheet feeding direction, the feed path R is provided with a fixing device 20 that fixes an unfixed image transferred to the sheet P. On the downstream side of the fixing device 20 in the sheet feeding direction, the feed path R is provided with a sheet discharge roller pair 13 which discharges the sheet P outside the image forming apparatus 1. Further, an upper surface portion of the body of the image forming apparatus 1 forms a sheet discharge tray 14 onto which the sheet P is discharged outside the image forming apparatus 1.

With reference to FIG. 3, basic operation of the image forming apparatus 1 according to the present embodiment will now be described. When an image forming operation starts, the photoconductors 5 of the image forming units 4Y, 4M, 4C, and 4K are driven to rotate clockwise in FIG. 3 by not-illustrated driving devices. Then, the outer circumferential surfaces of the photoconductors 5 are uniformly charged to a predetermined polarity by the charging devices 6. The charged outer circumferential surfaces of the photoconductors 5 are irradiated with beams of laser light by the exposure device 9. Thereby, electrostatic latent images are formed on the outer circumferential surfaces of the photoconductors 5. The exposure process is performed on each of the photoconductors 5 with image information of a single color separated from a desired full-color image, i.e., color information of the corresponding one of the yellow, magenta, cyan, and black colors. The electrostatic latent images thus formed on the photoconductors 5 are then supplied with the toners by the development devices 7. Thereby, the electrostatic latent images are rendered visible as toner images.

Further, when the image forming operation starts, the secondary transfer backup roller 32 is driven to rotate counterclockwise in FIG. 3, and causes the intermediate transfer belt 30 to rotate in the direction indicated by arrow A in FIG. 3. Then, each of the primary transfer rollers 31 is supplied with a constant voltage or a constant current-controlled voltage having a polarity opposite that of the toner. Thereby, transfer electric fields are generated in the primary transfer nips between the primary transfer rollers 31 and the photoconductors 5.

Thereafter, in accordance with the rotation of the photoconductors 5, the toner images of the respective colors on the photoconductors 5 reach the respective primary transfer nips, and are sequentially superimposed and transferred onto the intermediate transfer belt 30 by the transfer electric fields generated in the primary transfer nips. Thereby, a full-color toner image is carried by the outer circumferential surface of the intermediate transfer belt 30. Residual toners having failed to be transferred to the intermediate transfer belt 30 and remaining on the photoconductors 5 are removed by the cleaning devices 8. Thereafter, the outer circumferential surfaces of the photoconductors 5 are discharged by not-illustrated discharging devices, and respective surface potentials of the photoconductors 5 are initialized.

In a lower portion of the image forming apparatus 1, the sheet feed roller 11 starts to be driven to rotate, and feeds the sheet P to the feed path R from the sheet feeding tray 10. The sheet P fed to the feed path R is fed into the secondary transfer nip between the secondary transfer roller 36 and the secondary transfer backup roller 32 with appropriate timing by the registration roller pair 12. In this process, the secondary transfer roller 36 is supplied with a transfer voltage having a polarity opposite that of the toners of the toner images on the intermediate transfer belt 30 to generate a transfer electric field in the secondary transfer nip.

Thereafter, in accordance with the rotation of the intermediate transfer belt 30, the toner images on the intermediate transfer belt 30 reach the secondary transfer nip, and are transferred at the same time onto the sheet P by the transfer electric field generated in the secondary transfer nip. Residual toners having failed to be transferred to the sheet P and remaining on the intermediate transfer belt 30 are removed by the belt cleaning device 35 and transported to the not-illustrated waste toner container.

Thereafter, the sheet P is fed to the fixing device 20, and the toner images on the sheet P are fixed on the sheet P by the fixing device 20. Then, the sheet P is discharged outside the image forming apparatus 1 by the sheet discharge roller pair 13, and is placed onto the sheet discharge tray 14.

Although the above description has been given of the image forming operation of forming a full-color image on the sheet P, the image forming apparatus 1 is also capable of forming a monochromatic image by using only one of the four image forming units 4Y, 4M, 4C, and 4K, and forming an image of two or three colors by using two or three of the image forming units 4Y, 4M, 4C, and 4K.

Figure 4:
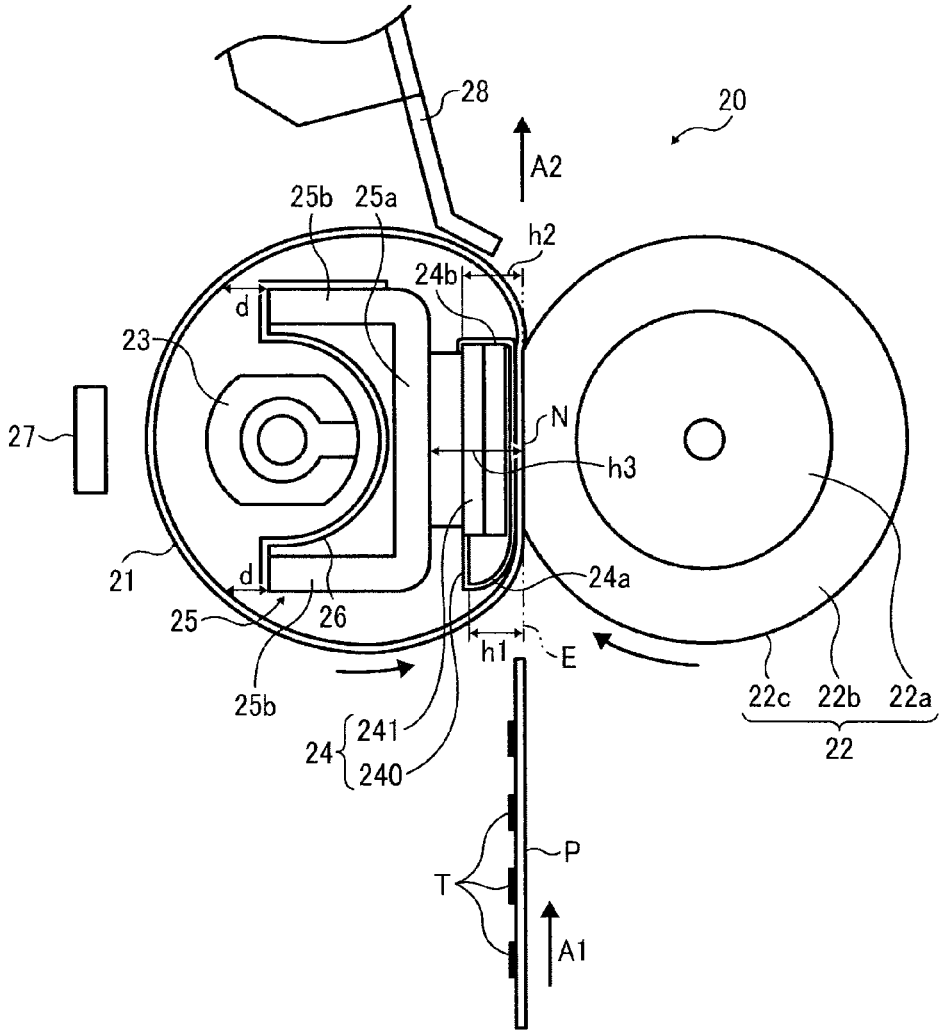
FIG. 4 is a schematic configuration diagram of a fixing device according to a first embodiment of the present invention.

The configuration of the fixing device 20 will now be described with reference to FIG. 4. As illustrated in FIG. 4, the fixing device 20 includes a fixing belt 21, a pressure roller 22, a halogen heater 23, a nip forming member 24, a stay 25, a reflector 26, a temperature sensor 27, a separator 28, and a not-illustrated biasing member. The fixing belt 21 serves as a rotatable fixing rotary member. The pressure roller 22 serves as an opposed rotary member rotatably provided facing the fixing belt 21. The halogen heater 23 serves as a heating source which heats the fixing belt 21. The nip forming member 24 is provided inside the loop formed by the fixing belt 21. The stay 25 serves as a support member which supports the nip forming member 24. The reflector 26 reflects light radiated from the halogen heater 23 onto the fixing belt 21. The temperature sensor 27 serves as a temperature detector which detects the temperature of the fixing belt 21. The separator 28 separates the sheet P from the fixing belt 21. The biasing member biases the pressure roller 22 against the fixing belt 21.

The fixing belt 21 is a relatively thin, flexible endless belt or film. Specifically, the fixing belt 21 includes a substrate on the inner circumferential side and a release layer on the outer circumferential side. The substrate is made of a metal material, such as nickel or stainless steel (SUS), or a resin material, such as polyimide (PI). The release layer is made of, for example, tetrafluoroethylene-perfluoroalkyl vinyl ether copolymer (PFA) or polytetrafluoroethylene (PTFE). An elastic layer made of a rubber material, such as a silicone rubber, a foamed silicone rubber, or a fluororubber, may be provided between the substrate and the release layer.

The pressure roller 22 includes a core bar 22*a*, an elastic layer 22*b*, and a release layer 22*c*. The elastic layer 22*b* is made of a foamed silicone rubber, a silicone rubber, or a fluororubber, for example, and provided on the outer circumferential surface of the core bar 22*a*. The release layer 22*c* is made of PFA or PTFE, for example, and provided on the outer circumferential surface of the elastic layer 22*b*. The pressure roller 22 is biased toward the fixing belt 21 by the not-illustrated biasing member to be in contact with the nip forming member 24 via the fixing belt 21. In the area of pressure contact between the pressure roller 22 and the fixing belt 21, the elastic layer 22*b* of the pressure roller 22 deforms to form a nip portion N having a predetermined width along the sheet feeding direction. Further, the pressure roller 22 is configured to be driven to rotate by a not-illustrated drive source, such as a motor, provided to the body of the image forming apparatus 1. When the pressure roller 22 is driven to rotate, drive force of the pressure roller 22 is transmitted to the fixing belt 21 in the nip portion N, and thereby the fixing belt 21 is driven to rotate.

Although the pressure roller 22 of the present embodiment is a solid roller, alternatively the pressure roller 22 may be a hollow roller. In that case, a heating source, such as a halogen heater, may be provided inside the pressure roller 22. Further, if the elastic layer 22*b* is absent, the heat capacity is reduced, and the fixing performance is improved. In the process of pressing and fixing the unfixed toner on the sheet P, however, minute irregularities of the outer circumferential surface of the fixing belt 21 may be transferred to the image and cause uneven glossiness in a solid portion of the image. To prevent such a phenomenon, it is preferable to provide an elastic layer having a thickness of approximately 100 μm or more. If an elastic layer having a thickness of approximately 100 μm or more is provided, the above-described minute irregularities are absorbed by the elastically deformed elastic layer, and thus the uneven glossiness is prevented. The elastic layer 22*b* may be made of solid rubber. If there is no heating source inside the pressure roller 22, the elastic layer 22*b* may be made of sponge rubber, in that sponge rubber improves heat insulation and suppresses heat loss of the fixing belt 21 better than solid rubber does. Further, the configuration of the fixing belt 21 serving as the fixing rotary member and the pressure roller 22 serving as the opposed rotary member is not limited to the configuration in which the fixing belt 21 and the pressure roller 22 press against each other. For example, the fixing belt 21 and the pressure roller 22 may be configured to simply be in contact with each other, with no pressure applied thereto.

The halogen heater 23 has opposed end portions fixed to not-illustrated side plates of the fixing device 20. The halogen heater 23 is configured to generate heat under output control by a not-illustrated power supply unit provided to the body of the image forming apparatus 1. The output control is performed on the basis of the result of detection of the surface temperature of the fixing belt 21 by the temperature sensor 27. With this output control of the halogen heater 23, the temperature of the fixing belt 21, i.e., the fixing temperature is adjustable to a desired temperature. Further, the heating source for heating the fixing belt 21 is not limited to a halogen heater, and alternatively may be an induction heater (1H), a resistance heater, or a carbon heater, for example.

The nip forming member 24 includes a base pad 241 and a sliding sheet 240 which is a low-friction sheet provided on at least a surface of the base pad 241 facing the inner circumferential surface of the fixing belt 21. The base pad 241 continuously extending in the axial direction of the fixing belt 21, i.e., the axial direction of the pressure roller 22, is subjected to pressure applied by the pressure roller 22, and determines the shape of the nip portion N. Further, the base pad 241 is fixedly supported by the stay 25. This configuration prevents the nip forming member 24 from being bent by the pressure applied by the pressure roller 22, and maintains a uniform nip width in the axial direction of the pressure roller 22. To prevent bending of the nip forming member 24, it is preferable to use a metal material having relatively high mechanical strength, such as stainless steel or iron, to form the stay 25. It is also preferable to use a relatively hard material to form the base pad 241 to secure the strength thereof. A resin such as liquid crystal polymer (LCP), a metal, or a ceramic, for example, may be used as the material forming the base pad 241.

Further, the base pad 241 is a heat-resistant member capable of withstanding temperatures of approximately 200 degrees Celsius or higher. Accordingly, deformation of the nip forming member 24 due to heat is prevented in a toner fixing temperature range, and a stable state of the nip portion N is secured to provide consistently good quality of the output image. The base pad 241 may be made of a commonly used heat-resistant resin, such as polyether sulfone (PES), polyphenylene sulfide (PPS), liquid crystal polymer (LCP), polyether nitrile (PEN), polyamide-imide (PAI), or polyether ether ketone (PEEK).

As noted above, the sliding sheet 240 is provided on at least a surface of the base pad 241 facing the inner circumferential surface of the fixing belt 21. With this configuration, the rotated fixing belt 21 slides over the low-friction sliding sheet 240. Thereby, drive torque generated in the fixing belt 21 is reduced, and a load on the fixing belt 21 due to friction is reduced. Alternatively, the nip forming member 24 may be configured without the sliding sheet 240.

The reflector 26 is provided between the stay 25 and the halogen heater 23. In the present embodiment, the reflector 26 is fixed to the stay 25. The reflector 26 may be made of a material such as aluminum or stainless steel, for example. With the thus-provided reflector 26, the light radiated from the halogen heater 23 toward the stay 25 is reflected to the fixing belt 21. Thereby, the amount of energy applied to the fixing belt 21 is increased, and the fixing belt 21 is efficiently heated. Further, the transfer of radiant heat from the halogen heater 23 to components such as the stay 25 is minimized. Accordingly, energy conservation is achieved.

The fixing device 20 according to the present embodiment has various features for achieving further energy conservation and reduction in first-print time. Specifically, a portion of the fixing belt 21 other than a portion of the fixing belt 21 corresponding to the nip portion N is directly heated by the halogen heater 23, i.e., heated by a direct heating method. In the present embodiment, the space between the halogen heater 23 and a left portion of the fixing belt 21 in FIG. 4 is not provided with any component, such that the radiant heat from the halogen heater 23 is directly applied to the fixing belt 21 in the space.

Further, to reduce the heat capacity of the fixing belt 21, the fixing belt 21 is reduced in thickness and diameter. Specifically, the respective thicknesses of the substrate, the elastic layer, and the release layer forming the fixing belt 21 are set to a range of from approximately 20 μm to approximately 50 μm, a range of from approximately 100 μm to approximately 300 μm, and a range of from approximately 10 μm to approximately 50 μm, respectively, and the overall thickness of the fixing belt 21 is set to approximately 1 mm or less. Further, the diameter of the fixing belt 21 in its deployed looped configuration is set to a range of from approximately 20 mm to approximately 40 mm. To achieve a further reduction in heat capacity, it is preferable to set the overall thickness of the fixing belt 21 to approximately 0.2 mm or less, more preferably approximately 0.16 mm or less, and to set the diameter of the fixing belt 21 in its deployed looped configuration to approximately 30 mm or less.

In the present embodiment, the diameter of the pressure roller 22 in its deployed looped configuration is set to a range of from approximately 20 mm to approximately 40 mm, i.e., the fixing belt 21 and the pressure roller 22 are configured to have a substantially equal diameter. The configuration of the fixing belt 21 and the pressure roller 22, however, is not limited to the above. For example, the fixing belt 21 and the pressure roller 22 may be configured such that the fixing belt 21 is smaller in diameter in its deployed looped configuration than the pressure roller 22. In that case, the curvature of the fixing belt 21 is greater than the curvature of the pressure roller 22 in the nip portion N, and thus the sheet P fed out of the nip portion N is more easily separated from the fixing belt 21.

The above-described reduction in diameter of the fixing belt 21 results in a reduction of the space inside the fixing belt 21. Accordingly, the stay 25 is bent at opposite ends thereof to be formed into a recessed shape, and the halogen heater 23 is housed inside the recessed stay 25. Accordingly, the reduced space is still capable of housing both the stay 25 and the halogen heater 23.

Further, to increase the size of the stay 25 as much as possible in the reduced space, the size of the nip forming member 24 is conversely reduced. Specifically, the width of the base pad 241 in the sheet feeding direction is set to be less than the width of the stay 25 in the sheet feeding direction. Further, in FIG. 4, the base pad 241 includes an upstream end portion 24*a* and a downstream end portion 24*b* in the sheet feeding direction, and the stay 25 includes an upstream bent portion and a downstream bent portion in the sheet feeding direction. Herein, the base pad 241 is configured to satisfy relationships $h1 \leq h3$ and $h2 \leq h3$, wherein h1 represents the height of the upstream end portion 24*a* from the nip portion N or a virtual extension E thereof, h2 represents the height of the downstream end portion 24*b* from the nip portion N or the virtual extension E, and h3 represents the maximum height of the remaining portion of the base pad 241 other than the upstream end portion 24*a* and the downstream end portion 24*b* from the nip portion N or the virtual extension E. With this configuration, the upstream end portion 24*a* of the base pad 241 is not located between the fixing belt 21 and the upstream bent portion of the stay 25. More strictly, a lower portion of the upstream end portion 24*a* is not located between the fixing belt 21 and the outer portion of the upstream bent portion of the stay 25. Further, the downstream end portion 24*b* of the base pad 241 is not located between the fixing belt 21 and the downstream bent portion of the stay 25. Therefore, the stay 25 is disposed with the upstream and downstream bent portions thereof located relatively close to the inner circumferential surface of the fixing belt 21. Accordingly, the size of the stay 25 is increased as much as possible in the limited space inside the fixing belt 21 to reinforce the stay 25. Consequently, the nip forming member 24 is prevented from being bent by the pressure roller 22, and the fixing performance is improved.

Further, to reinforce the stay 25, the stay 25 of the present embodiment is configured to include a base portion 25*a* and arms 25*b* substantially perpendicular to the base portion 25*a*. The base portion 25*a* is in contact with the nip forming member 24, and extends in the sheet feeding direction, i.e., the vertical direction in FIG. 4. From an upstream end portion and a downstream end portion of the base portion 25*a* in the sheet feeding direction, the arms 25*b* rise and extend in the direction in which the pressure roller 22 comes into contact with the fixing belt 21, i.e., toward the left side of FIG. 4 (hereinafter referred to as the contact direction of the pressure roller 22). That is, the stay 25 including the arms 25*b* has an elongated cross section extending in the pressurizing direction of the pressure roller 22. Accordingly, the section modulus is increased, and the mechanical strength of the stay 25 is increased.

Further, if the arms 25*b* are increased in length in the contact direction of the pressure roller 22, the strength of the stay 25 is increased. Therefore, it is preferable that respective leading ends of the arms 25*b* are as close as possible to the inner circumferential surface of the fixing belt 21. During the rotation of the fixing belt 21, however, some deflection, i.e., disturbance in behavior occurs in the fixing belt 21. If the leading ends of the arms 25*b* are too close to the inner circumferential surface of the fixing belt 21, therefore, the fixing belt 21 may come into contact with the leading ends of the arms 25*b*. Particularly in the configuration using the relatively thin fixing belt 21, as in the present embodiment, the range of deflection of the fixing belt 21 is relatively large. Therefore, positioning of the leading ends of the arms 25*b* requires attention.

Specifically, in the present embodiment, it is preferable to set a distance d between each of the leading ends of the arms 25*b* and the inner circumferential surface of the fixing belt 21 in the contact direction of the pressure roller 22 to at least approximately 2.0 mm, more preferably approximately 3.0 mm or more. Conversely, if the fixing belt 21 is thick enough to have little deflection, the distance d may be set to approximately 0.02 mm. If the reflector 26 is attached to the leading ends of the arms 25*b*, as in the present embodiment, the distance d is set such that the reflector 26 will not come into contact with the fixing belt 21.

With the leading ends of the arms 25*b* thus disposed to be as close as possible to the inner circumferential surface of the fixing belt 21, the arms 25*b* are increased in length in the contact direction of the pressure roller 22. Accordingly, the mechanical strength of the stay 25 is increased even in the configuration using the fixing belt 21 having the reduced diameter.

Figure 5A:
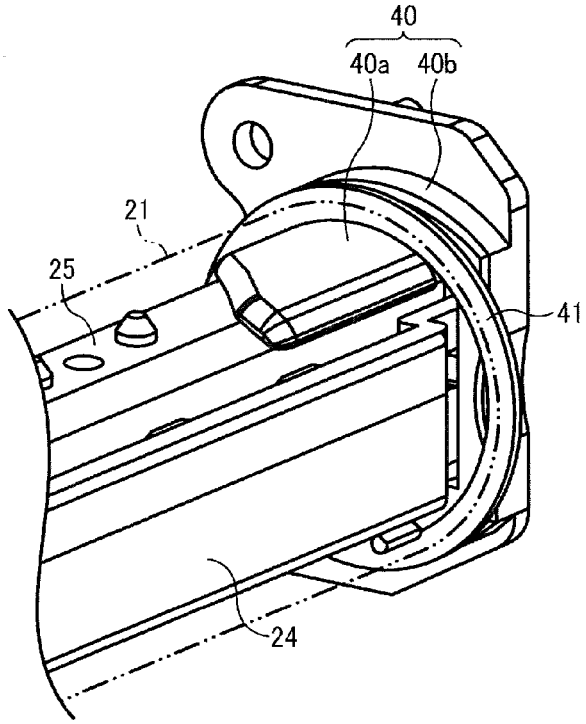
FIGS. 5A to 5C are diagrams illustrating the configuration of one end portion of a fixing belt included in the fixing device, FIG. 5A being a perspective view, FIG. 5B being a plan view, and FIG. 5C being an end-on side view as viewed along the rotation axis of the fixing belt.
Figure 5B:
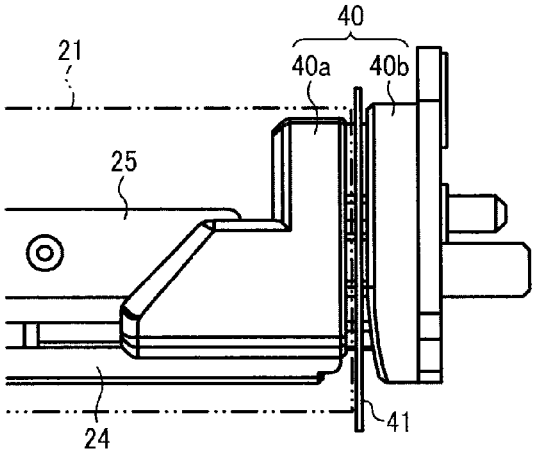
Figure 5C:
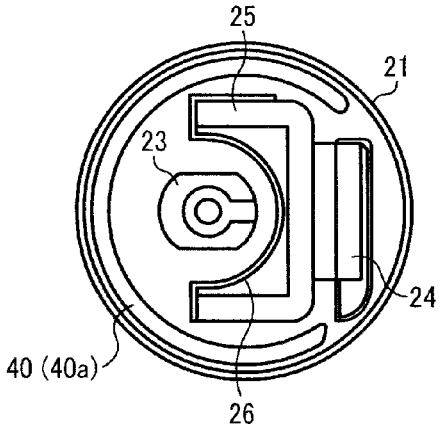

FIGS. 5A to 5C are diagrams illustrating the configuration of one end portion of the fixing belt 21. FIG. 5A is a perspective view, FIG. 5B is a plan view, and FIG. 5C is an end-on side view as viewed along the rotation axis of the fixing belt 21. The illustration of FIGS. 5A to 5C is limited to the configuration of one end portion of the fixing belt 21. Although not illustrated, the other end portion of the fixing belt 21 has a similar configuration. In the following, therefore, description with reference to FIGS. 5A to 5C will be limited to the configuration of the one end portion of the fixing belt 21.

As illustrated in FIGS. 5A and 5B, a belt holding member 40 is inserted in an end portion of the fixing belt 21 to rotatably hold the fixing belt 21. The belt holding member 40 includes an insertion portion 40*a* and a restricting portion 40*b*. The insertion portion 40*a* is inserted in the end portion of the fixing belt 21. The restricting portion 40*b* is formed to be larger in outer diameter than the insertion portion 40*a*, and to be larger than at least the outer diameter of the fixing belt 21. If the fixing belt 21 walks in the axial direction thereof, the restricting portion 40*b* restricts the belt walk. As illustrated in FIG. 5C, the insertion portion 40*a* is formed into a substantially C-shaped member in cross-section having an opening at a position corresponding to the nip portion N, i.e., a position provided with the nip forming member 24. Further, an end portion of the stay 25 is fixed to and positioned by the belt holding member 40.

As illustrated in FIGS. 5A and 5B, a slip ring 41 serving as a protecting member for protecting the end portion of the fixing belt 21 is provided between an end surface of the fixing belt 21 and the restricting portion 40*b* of the belt holding member 40 facing the end surface of the fixing belt 21. If the fixing belt 21 walks in the axial direction thereof, therefore, the end portion of the fixing belt 21 is prevented from coming into direct contact with the restricting portion 40*b* of the belt holding member 40, and abrasion or damage of the end portion of the fixing belt 21 is prevented. Further, the slip ring 41 fits around the belt holding member 40 with a gap provided between the slip ring 41 and the outer circumference of the belt holding member 40. When the end portion of the fixing belt 21 comes into contact with the slip ring 41, therefore, the slip ring 41 rotates together with the fixing belt 21. The slip ring 41 may also be configured to remain at rest, without rotating together with the fixing belt 21. It is preferable to use so-called super engineering plastic having relatively high heat resistance, such as PEEK, PPS, PAI, or PTFE, for example, as the material forming the slip ring 41.

Although not illustrated, blocking members for blocking the heat from the halogen heater 23 are provided to the end portions in the axial direction of the fixing belt 21 between the fixing belt 21 and the halogen heater 23. This configuration suppresses an excessive increase in temperature in sheet non-passing areas of the fixing belt 21 particularly in continuous sheet feeding, and thereby prevents degradation of or damage to the fixing belt 21 due to heat.

With reference to FIG. 4, basic operation of the fixing device 20 according to the present embodiment will now be described. When a not-illustrated power switch provided to the body of the image forming apparatus 1 is turned on, power is supplied to the halogen heater 23. At the same time, the pressure roller 22 starts to be driven to rotate clockwise in FIG. 4. Thereby, the fixing belt 21 is driven to rotate counterclockwise in FIG. 4 by friction acting between the pressure roller 22 and the fixing belt 21.

Thereafter, the sheet P carrying an unfixed toner image T formed by the foregoing image forming process is fed in the direction of arrow A1 in FIG. 4 while being guided by not-illustrated guide plates, and is fed into the nip portion N between the fixing belt 21 and the pressure roller 22 pressing against each other. Then, the toner image T is fixed on a surface of the sheet P by the heat of the fixing belt 21 heated by the halogen heater 23 and the pressure exerted by the fixing belt 21 and the pressure roller 22.

The sheet P having the toner image T fixed thereon is fed out of the nip portion N in the direction of arrow A2 in FIG. 4. In this process, the leading end of the sheet P comes into contact with the leading end of the separator 28, and thereby the sheet P is separated from the fixing belt 21. Thereafter, the separated sheet P is discharged outside the image forming apparatus 1 by the sheet discharge roller pair 13 and placed onto the sheet discharge tray 14, as described above.

Figure 6:
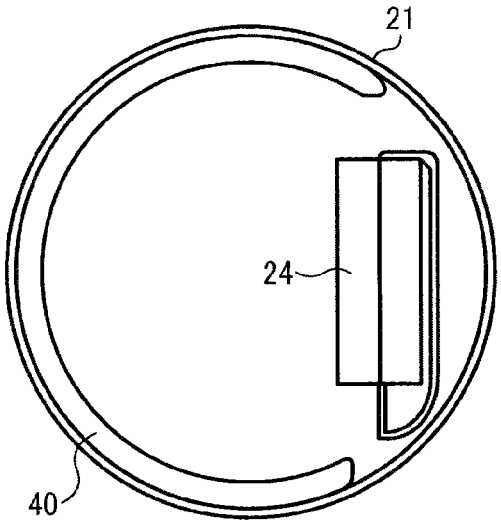
FIG. 6 is a side view of the fixing belt not in contact with a pressure roller included in the fixing device.

FIG. 6 is a side view of the fixing belt 21 not in contact with the pressure roller 22. As illustrated in FIG. 6, in a state in which the fixing belt 21 is not in contact with the pressure roller 22, the pressure applied by the pressure roller 22 is absent, and thus the fixing belt 21 has the shape of a substantially perfect circle owing to elastic force thereof. The shape of the fixing belt 21 not in contact with the pressure roller 22 is affected by the shape of the outer circumference of the belt holding member 40. In the present embodiment, the outer circumference of the belt holding member 40 also has the shape of a substantially perfect circle. Therefore, the fixing belt 21 is held in a free state, i.e., a no-load state or in a state close thereto. The configuration, however, is not limited thereto, and the fixing belt 21 in its free state may be deformed in accordance with the shape of the outer circumference of the belt holding member 40 and held in the deformed state. Further, in a state in which the fixing belt 21 is not in contact with the pressure roller 22, the nip forming member 24 is disposed at a position spaced inward from the fixing belt 21.

Figure 7:
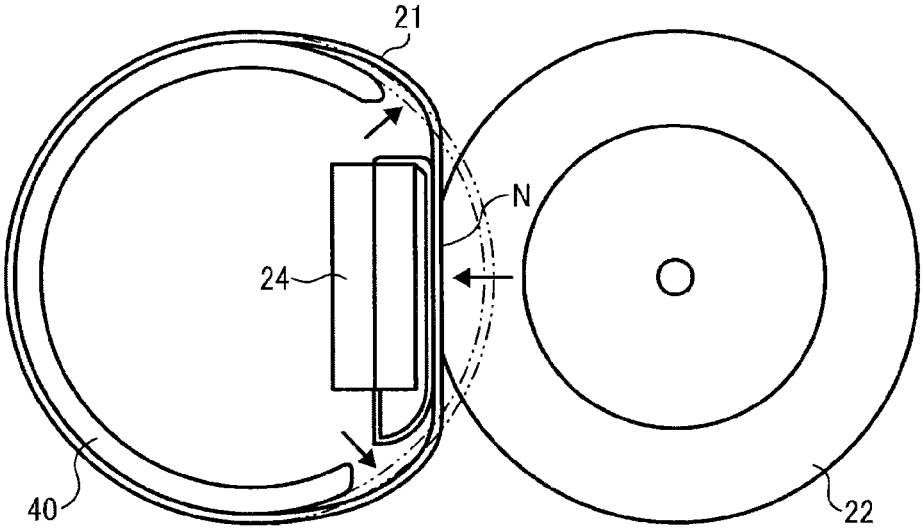
FIG. 7 is a side view of the fixing belt in contact with the pressure roller.

Further, as illustrated in FIG. 7, when the pressure roller 22 is brought into contact with the fixing belt 21 to place the fixing belt 21 in a pressurized state, the fixing belt 21 is pressed radially inward at the position of the nip forming member 24 by the pressure roller 22. As a result, the fixing belt 21 conversely bulges outward on the upstream and downstream sides of the nip portion N in the sheet feeding direction, such that the fixing belt 21 is barely pressed against the nip forming member 24 on the upstream and downstream sides of the nip portion N in the sheet feeding direction.

Figure 8:
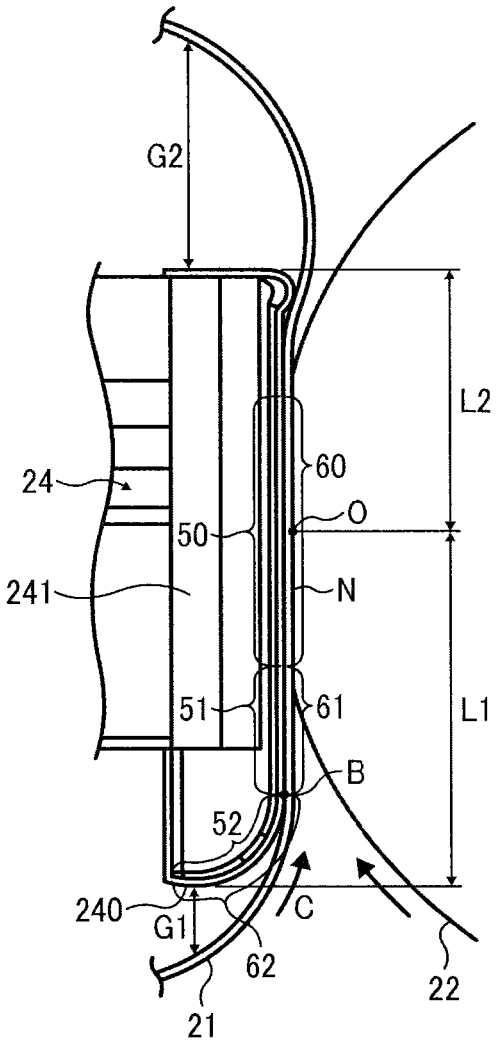
FIG. 8 is an enlarged view of a nip portion in the fixing device illustrated in FIG. 4.

The configuration of the nip forming member 24 will now be described in detail with reference to FIG. 8. In FIG. 8, L1 represents the length of an upstream portion of the nip forming member 24 extending upstream in the sheet feeding direction from a center O of the nip portion N, and L2 represents the length of a downstream portion of the nip forming member 24 extending downstream in the sheet feeding direction from the center O of the nip portion N. As illustrated in FIG. 8, the nip forming member 24 is configured such that the length L1 is greater than the length L2. Further, in FIG. 8, G1 represents the gap in the sheet feeding direction between an upstream end portion of the nip forming member 24 and the inner circumferential surface of the fixing belt 21, and G2 represents the gap in the sheet feeding direction between a downstream end portion of the nip forming member 24 and the inner circumferential surface of the fixing belt 21. As illustrated in FIG. 8, the nip forming member 24 is configured such that the gap G1 is less than the gap G2. That is, in the present embodiment, the nip forming member 24 is configured such that the upstream portion extending upstream in the sheet feeding direction from the center O of the nip portion N is relatively long. With the relatively long upstream portion, the nip forming member 24 is capable of guiding the fixing belt 21 entering the nip portion N. With this configuration, the behavior of the fixing belt 21 before entering the nip portion N is controlled, thereby allowing the fixing belt 21 to smoothly enter the nip portion N.

Further, in the present embodiment, a surface of the base pad 241 on the side of the pressure roller 22 includes a contact portion 50, an extended portion 51, and a curved portion 52. The contact portion 50 is formed into a substantially flat surface in contact with the pressure roller 22 via the fixing belt 21. The extended portion 51 extends upstream in the sheet feeding direction from the contact portion 50, and is not in contact with the pressure roller 22 via the fixing belt 21. Further, the extended portion 51 is formed into a substantially flat surface on the same plane as the contact portion 50. The fixing belt 21 rotates in the direction of arrow C in FIG. 8, and enters the nip portion N while sliding over the extended portion 51 via the sliding sheet 240. That is, the extended portion 51 functions as a guide for guiding the fixing belt 21 to the contact portion 50.

The contact portion 50 and the extended portion 51 may each be formed into a recessed curved surface recessed radially inward from the fixing belt 21 or any other shape, as well as the substantially flat surface. Particularly in a case where the contact portion 50 and the extended portion 51 are each formed into a recessed curved surface, the leading end of the sheet P having passed the nip portion N is discharged toward the pressure roller 22. Accordingly, the present configuration is advantageous in improving the separability of the sheet P from the fixing belt 21 and suppressing a feeding failure, such as a sheet jam.

The curved portion 52 continues upstream in the sheet feeding direction from the extended portion 51. The curved portion 52 is formed to project radially outward from the fixing belt 21. At a boundary B between the curved portion 52 and the extended portion 51, the curved portion 52 is formed to smoothly continue from the extended portion 51 such that no edge is formed at the boundary B.

The base pad 241 thus includes the contact portion 50 in contact with the pressure roller 22, the extended portion 51 extending upstream in the sheet feeding direction from the contact portion 50, and the curved portion 52 provided to smoothly continue upstream in the sheet feeding direction from the extended portion 51. Further, the sliding sheet 240 is provided in accordance with the shape of the base pad 241. Similarly to the base pad 241, therefore, the sliding sheet 240 includes a substantially flat contact portion 60, a substantially flat extended portion 61, and a curved portion 62, which respectively correspond to the contact portion 50, the extended portion 51, and the curved portion 52 of the base pad 241.

The fixing belt 21 is configured not to be in contact with the curved portion 62 of the sliding sheet 240 when not rotated. Further, the curved portion 62 of the sliding sheet 240 is disposed not to be in contact with an ideal rotation locus of the fixing belt 21, i.e., a rotation locus of the fixing belt 21 obtained when there is no disturbance in behavior of the fixing belt 21. Basically, therefore, there is no continuous contact between the fixing belt 21 and the curved portion 62 of the sliding sheet 240 during the rotation of the fixing belt 21. It is, however, assumed that there is some disturbance in behavior of the fixing belt 21 during actual rotation of the fixing belt 21, and thus the fixing belt 21 may come into incidental contact with the curved portion 62 of the sliding sheet 240, depending on the disturbance in behavior thereof. Even in such a case, the sliding sheet 240 has the curved portion 62 smoothly continuing from the extended portion 61 in accordance with the shape of the base pad 241, and therefore abrasion of the fixing belt 21 is effectively suppressed. Further, the base pad 241 has the curved portion 52 smoothly continuing from the extended portion 51, and therefore abrasion of the sliding sheet 240 due to the contact of the sliding sheet 240 with the base pad 241 is also effectively suppressed.

To further reduce a friction load on the fixing belt 21 due to the contact between the fixing belt 21 and the curved portion 62 of the sliding sheet 240, it is preferable to form the curved portion 52 of the base pad 241 to be close to the ideal rotation locus of the fixing belt 21.

Figure 9:
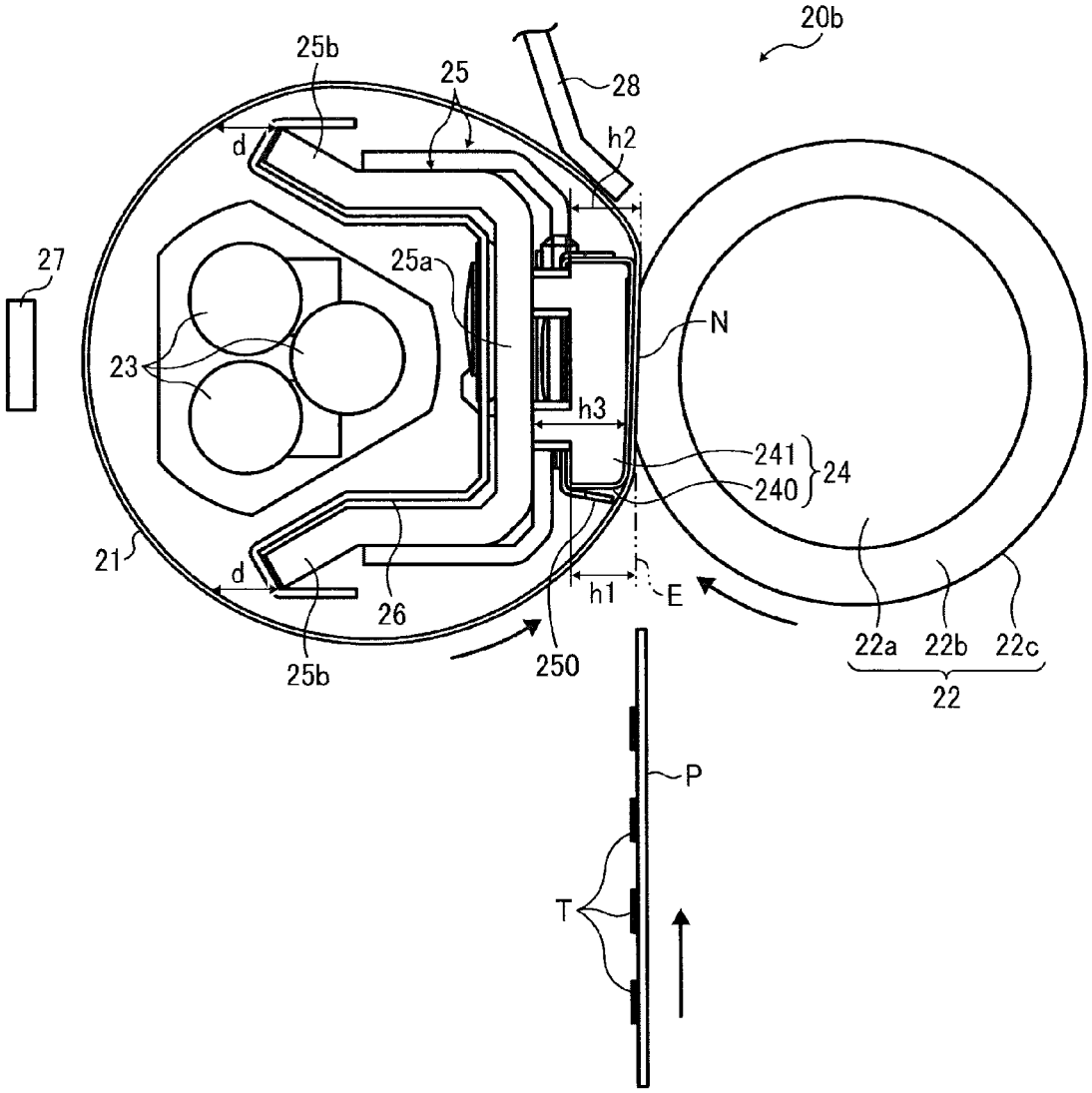
FIG. 9 is a schematic configuration diagram of a fixing device according to a second embodiment of the present invention.
Figure 10:
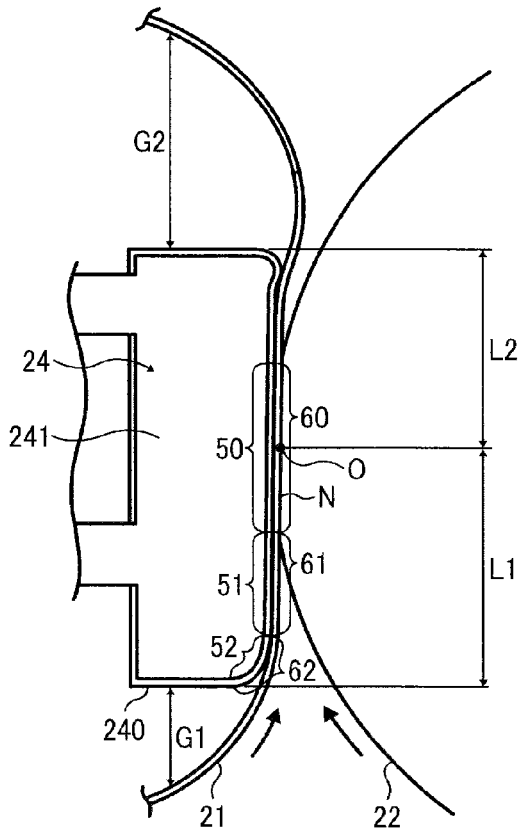
FIG. 10 is an enlarged view of a nip portion in the fixing device illustrated in FIG. 9.

FIG. 9 is a diagram illustrating the configuration of a fixing device 20*b* according to a second embodiment of the prevent invention. FIG. 10 is an enlarged view of the nip portion N in the fixing device 20*b*. The fixing device 20*b* illustrated in FIGS. 9 and 10 includes three halogen heaters 23 serving as heating sources, and is different from the fixing device 20 illustrated in FIG. 4 in the shape of components such as the stay 25 and the reflector 26. In this case, if the halogen heaters 23 are configured to have different heat generating areas, it is possible to heat different areas of the fixing belt 21 differently depending on the difference in sheet width. Further, the arms 25*b* of the stay 25 respectively include distal tips and proximal base ends attached to the base portion 25*a* of the stay 15, such that the tips are more widely spaced apart than the base ends. Further, the fixing device 20*b* includes a metal plate 250 which surrounds the nip forming member 24 to reinforce the nip forming member 24, and via which the nip forming member 24 is supported by the stay 25. In the other aspects, the fixing device 20*b* is basically similar in configuration to the fixing device 20 of the first embodiment.

Also in the present embodiment, therefore, the nip forming member 24 is configured such that the length L1 of the upstream portion extending upstream in the sheet feeding direction from the center O of the nip portion N is greater than the length L2 of the downstream portion extending downstream in the sheet feeding direction from the center O of the nip portion N, as illustrated in FIG. 10. Further, the nip forming member 24 is configured such that the gap G1 in the sheet feeding direction between the upstream end portion of the nip forming member 24 and the inner circumferential surface of the fixing belt 21 is less than the G2 in the sheet feeding direction between the downstream end portion of the nip forming member 24 and the inner circumferential surface of the fixing belt 21.

Further, although not illustrated, the nip forming member 24 of the present configuration is also disposed at a position spaced inward from the fixing belt 21 in a state in which the fixing belt 21 is not in contact with the pressure roller 22, similarly as in the configuration described above with reference to FIG. 6. In FIG. 9, h1, h2, and h3 respectively represent the height of the upstream end portion of the base pad 241, the height of the downstream end portion of the base pad 241, and the maximum height of the remaining portion of the base pad 241, similarly as in the first embodiment. Also in the present embodiment, the base pad 241 is configured to satisfy the relationships $h1 \leq h3$ and $h2 \leq h3$ to increase the size of the stay 25 as much as possible in the reduced space.

Figure 11:
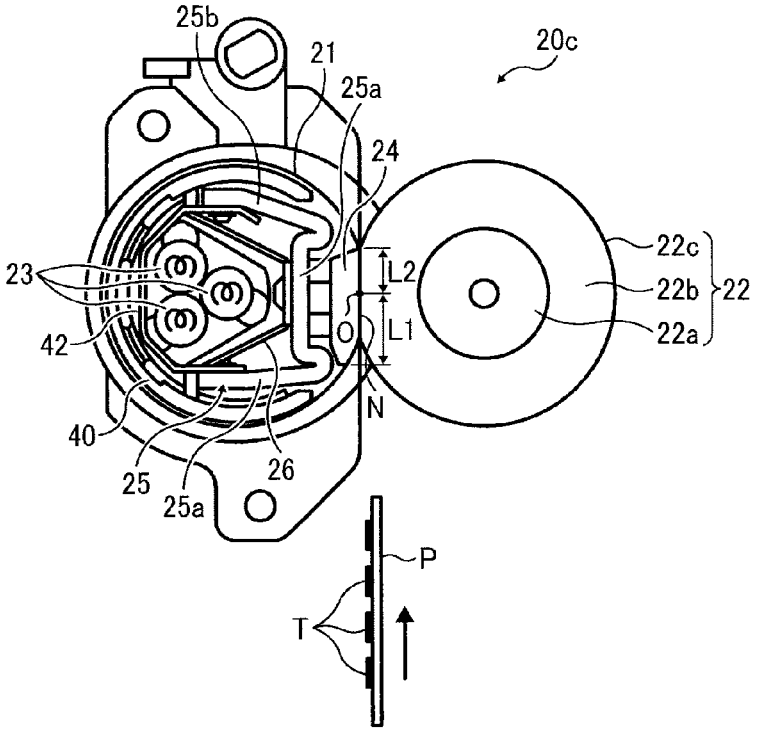
FIG. 11 is a schematic configuration diagram of a fixing device according to a third embodiment of the present invention.

FIG. 11 is a diagram illustrating the configuration of a fixing device 20*c* according to a third embodiment of the prevent invention. The fixing device 20*c* illustrated in FIG. 11 includes three halogen heaters 23 and is different from the fixing device 20 in the shape of components such as the stay 25 and the reflector 26, similarly to the fixing device 20*b* illustrated in FIG. 9. Specifically, the stay 25 has a substantially W-shaped form in cross-section, with a portion of the stay 25 where the arms 25*b* are joined to the base portion 25*a* projecting toward the nip forming member 24. Additionally, the reflector 26 has a substantially V-shaped form in cross-section, as a result of which the reflector 26 does not conform to the shape of the stay 25 as in the previous embodiments but instead is spaced apart from the arms 25*b* of the stay 25. The fixing device 20*c*, however, is similar in basic configuration to the fixing device 20 of the first embodiment, and thus detailed description of the configuration of the fixing device 20*c* will be omitted. Also in the fixing device 20*c*, the nip forming member 24 is configured such that the length L1 of the upstream portion extending upstream in the sheet feeding direction from the center O of the nip portion N is greater than the length L2 of the downstream portion extending downstream in the sheet feeding direction from the center O of the nip portion N, similarly as in the first embodiment.

As described above, according to the embodiments of the present invention, the nip forming member 24 guides the fixing belt 21 entering the nip portion N. Therefore, the behavior of the fixing belt 21 before entering the nip portion N is controlled, thereby allowing the fixing belt 21 to stably and smoothly enter the nip portion N. According to the embodiments having the nip forming member 24 thus guiding the fixing belt 21, therefore, the fixing belt 21 is stably and smoothly rotated even in the configuration in which a portion of the fixing belt 21 other than the opposed end portions (i.e., lateral end portions) thereof is not provided with any other guide member than the nip forming member 24. Accordingly, the load placed on the fixing belt 21 during the rotation thereof is reduced, and abrasion of the fixing belt 21 is suppressed. Consequently, damage or breakage of the fixing belt 21 is prevented, and device reliability is improved. Particularly in the configuration using the fixing belt 21 reduced in thickness to reduce the heat capacity, as in the embodiments, the strength of the fixing belt 21 is reduced. Therefore, the configuration of the embodiments of the present invention is expected to be substantially effective, when applied to such a fixing device.

Further, according to the embodiments of the present invention, the nip forming member 24 is capable of guiding the fixing belt 21, and thus the configuration of the fixing device is simplified and reduced in size. Accordingly, a further reduction in heat capacity of the fixing device is achieved, and the improvement of energy conservation and the reduction in first-print time are achieved.

Further, with the nip forming member 24 functioning as a guide member, there is no need to provide a separate guide member. Therefore, the fixing device is configured such that no component is present between the inner circumferential surface of the fixing belt 21 and the upstream and downstream end portions of the stay 25 in the sheet feeding direction, i.e., such that the inner circumferential surface of the fixing belt 21 and the upstream and downstream end portions of the stay 25 directly face each other. Accordingly, the stay 25 is disposed with the upstream and downstream end portions thereof in the sheet feeding direction located relatively close to the inner circumferential surface of the fixing belt 21, and the size of the stay 25 is increased as much as possible in the limited space inside the fixing belt 21. As a result, the strength of the stay 25 is secured even in the configuration in which the fixing belt 21 is reduced in diameter to reduce the heat capacity, as in the embodiments. Consequently, the nip forming member 24 is prevented from being bent by the pressure roller 22, and the fixing performance is improved.

Further, in the embodiments of the present invention, the nip forming member 24 is disposed at a position spaced inward from the fixing belt 21 in a state in which the fixing belt 21 is not in contact with the pressure roller 22. Thereby, the fixing belt 21 is barely pressed against the nip forming member 24 on the upstream and downstream sides of the nip portion N in the sheet feeding direction. Accordingly, the friction load on the fixing belt 21 and the abrasion of the fixing belt 21 due to the contact between the fixing belt 21 and the nip forming member 24 are reduced. Further, the force with which the fixing belt 21 comes into contact with the nip forming member 24 is reduced, and thereby a desirable entry route of the fixing belt 21 entering the nip portion N is obtained.

Further, the base pad 241 includes the substantially flat extended portion 51 which guides the fixing belt 21, and thus the fixing belt 21 is stably and smoothly rotated. Further, even if the fixing belt 21 comes into contact with the curved portion 52 of the base pad 241 via the sliding sheet 240, the curved portion 52 smoothly continues from the extended portion 51, and thus the abrasion of the fixing belt 21 and the sliding sheet 240 is effectively suppressed.

The application of a fixing device according to an embodiment of the present invention is not limited to the color laser printer illustrated in FIG. 3. The fixing device is also installable in, for example, a monochrome image forming apparatus, a different type of printer, a copier, a facsimile machine, and a multifunction machine combining several of the functions of these apparatuses.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. A fixing device which fixes an image on a recording medium, the fixing device comprising:

an endless fixing rotary member formed into a loop to come into contact with the image carried on the recording medium;

an opposed rotary member to contact the fixing rotary member;

a nip forming member inside the loop formed by the fixing rotary member to be in contact with the opposed rotary member via the fixing rotary member to form, between the fixing rotary member and the opposed rotary member, a nip portion to which the recording medium is fed in a feeding direction, the nip forming member including a downstream portion extending downstream in the feeding direction from a center of the nip portion and an upstream portion extending upstream in the feeding direction from the center of the nip portion and longer than the downstream portion;

a support member to support the nip forming member; and a heating source to heat the fixing rotary member, wherein a gap extending parallel to the feeding direction between an edge, which is perpendicular to the feeding direction, of an upstream end portion of the nip forming member and an inner circumferential surface of the fixing rotary member is less than a gap extending parallel to the feeding direction between an edge, which is perpendicular to the feeding direction, of a downstream end portion of the nip forming member and the inner circumferential surface of the fixing rotary member.

2. The fixing device according to claim 1, wherein the heating source heats the fixing rotary member where the fixing rotary member is away from the nip portion.

3. The fixing device according to claim 1, further comprising holding members configured to rotatably hold the fixing rotary member and regulate the axial position thereof by contact with lateral end portions of the fixing rotary member.

4. The fixing device according to claim 1, wherein the nip forming member guides a portion of the fixing rotary member other than lateral end portions of the fixing rotary member.

5. The fixing device according to claim 1, wherein the nip forming member comprises a base pad which determines the shape of the nip portion, and wherein the base pad comprises a contact portion which is in contact with the opposed rotary member via the fixing rotary member, an extended portion which is not in contact with the opposed rotary member and extends upstream in the feeding direction from the contact portion, and over which the fixing rotary member slides, and a curved portion which is not in contact with the opposed rotary member and is provided to smoothly continue upstream in the feeding direction from the extended portion.

6. The fixing device according to claim 5, wherein the fixing rotary member is not in contact with the curved portion of the nip forming member in a state in which the opposed rotary member is separated from the fixing rotary member.

7. The fixing device according to claim 5, wherein a width of the base pad in the feeding direction is less than a width of the support member in the feeding direction.

8. The fixing device according to claim 5, wherein the base pad satisfies relationships $h1 \leq h3$ and $h2 \leq h3$, wherein h1 represents a height of an upstream end portion in the feeding direction of the base pad from one of the nip portion and a virtual extension thereof, h2 represents a height of a downstream end portion in the feeding direction of the base pad from one of the nip portion and the virtual extension, and h3 represents a maximum height of a central portion of the base pad.

9. The fixing device according to claim 1, wherein the support member has an upstream end portion and a downstream end portion in the feeding direction which directly face an inner circumferential surface of the fixing rotary member.

10. The fixing device according to claim 1, wherein the support member has a recessed portion, and the heating source is disposed within the recessed portion.

11. The fixing device according to claim 1, wherein the rotary fixing member comprises one of an endless belt and an endless film.

12. The fixing device according to claim 1, further comprising a reflector disposed between the heating source and the support member.

13. The fixing device according to claim 1, wherein the support member comprises a linear base portion that supports the nip forming member and two arms extending substantially perpendicularly from the base portion on a side of the support member away from the nip forming member.

14. The fixing device according to claim 13, wherein the arms of the support member each comprise distal tips and proximal base ends attached to the base portion of the support member, wherein the tips of the arms are more widely spaced apart than the base ends.

15. The fixing device according to claim 1, wherein the support member has a substantially W-shaped form in cross-section.

16. An image forming apparatus comprising:

an image forming unit to form an image on a recording medium; and a fixing device according to claim 1, to fix the image on the recording medium.

17. The fixing device according to claim 1, further comprising:

rotatable guides disposed at each lateral end of the fixing rotary member to contact the fixing rotary member without extending under the fixing rotary member, the rotatable guides restricting movement of the fixing rotary member in an axial direction.

18. The fixing device according to claim 1, wherein the nip forming member comprises a base pad which determines a shape of the nip portion, the base bad comprising:

a contact portion in contact with the opposed rotary member via the fixing rotary member; and an extended portion not in contact with the opposed rotary member and extending upstream in the feeding direction from the contact portion, and over which the fixing rotary member slides, wherein the contact portion and the extended portion are disposed on a same plane.

19. The fixing device according to claim 1, wherein the nip forming member comprises a base pad which determines a shape of the nip portion, the base bad comprising:

a contact portion in contact with the opposed rotary member via the fixing rotary member; and an extended portion not in contact with the opposed rotary member and extending upstream in the feeding direction from the contact portion, and over which the fixing rotary member slides, wherein the contact portion and the extended portion each include a recessed curved surface recessed radially inward from the fixing belt.

20. A fixing device which conveys a recording medium on which an unfixed image is carried and fixes the image onto the recording medium, comprising:

an endless rotary fixing belt;

a base pad disposed inside a loop of the fixing belt;

an opposed rotary member to contact the base pad via the fixing belt, to thereby form a nip portion between the fixing belt and the opposed rotary member; and a heater to directly heat the fixing belt in a region which is away from the nip portion, from inside the loop of the fixing belt, without contacting the fixing belt and without directly heating the base pad, wherein the base pad includes, from downstream in a rotation direction of the fixing belt, a first surface to form the nip portion;

a second surface disposed upstream from the first surface and upstream of an entrance to the nip portion in the belt rotation direction;

a curved third surface disposed upstream of the second surface in the belt rotation direction, and wherein the second surface is fiat, and wherein the fixing belt is away from the third surface when the fixing belt is not rotating.

21. The fixing device according to claim 20, wherein the first surface is flat.

22. The fixing device according to claim 20, wherein:

the opposed rotary member includes an elastic layer, and the base pad includes a material having a higher rigidity than a rigidity of the elastic layer of the opposed rotary member.

23. The fixing device according to claim 20, wherein the base pad includes a friction sheet disposed on a surface thereof opposite the fixing belt.

24. The fixing device according to claim 20, wherein the heater is disposed directly opposite an inner circumferential surface of the fixing belt.

25. The fixing device according to claim 20, wherein the third surface includes a convex shape facing toward an inner surface of the fixing belt.

26. The fixing device according to claim 20, further comprising:

a support to support the base pad, wherein the support has an upstream end portion and a downstream end portion in the feeding direction which directly faces an inner circumferential surface of the fixing belt.

27. The fixing device according to claim 26, wherein the support has a recessed portion, and the heater is disposed within the recessed portion.

28. The fixing device according to claim 27, wherein a width of the base pad in the feeding direction is less than a width of the support in the feeding direction.

29. An image forming apparatus comprising a fixing device according to claim 20.

30. The fixing device according to claim 20, wherein:

a portion of the first surface corresponds to the entrance to the nip portion, and the second surface and the portion of the first surface are on a same surface.

31. The fixing device according to claim 20, further comprising:

a support system to support the base pad, wherein the support system includes:

an upstream side wall;

a downstream side wall opposite to the upstream side wall; and a bottom wall connecting the upstream side wall and the downstream side wall, the bottom wall supporting the base pad.

32. The fixing device according to claim 26, wherein:

the fixing belt includes two ends which are lateral ends, the fixing device further comprising:

a slip ring disposed at each of the two ends of the fixing belt to protect the two ends of the fixing belt, wherein the slip ring is rotatable.

33. The fixing device according to claim 26, wherein:

a contact width between the base pad and the support is smaller than a width of the base pad.

34. The fixing device according to claim 26, wherein:

the base pad includes a plurality of projecting portions each projecting toward the support.

35. The fixing device according to claim 26, further comprising:

a sliding sheet interposed between the base pad and the fixing belt.

36. The fixing device according to claim 26, wherein:

the base pad includes liquid polymer.

* * * * *